US011415075B2

(12) United States Patent
Zehr et al.

(10) Patent No.: US 11,415,075 B2
(45) Date of Patent: Aug. 16, 2022

(54) PORT SHAPES FOR ENHANCED ENGINE BREATHING

(71) Applicant: Cummins Inc., Columbus, IN (US)

(72) Inventors: Randall L. Zehr, Columbus, IN (US); Robert G. Sperry, Columbus, IN (US)

(73) Assignees: CUMMINS INC., Columbus, IN (US); ACHATES POWER, INC., San Diego, CA (US)

( * ) Notice: Subject to any disclaimer, the term of this patent is extended or adjusted under 35 U.S.C. 154(b) by 0 days.

(21) Appl. No.: 16/922,004

(22) Filed: Jul. 7, 2020

(65) Prior Publication Data

US 2021/0010442 A1 Jan. 14, 2021

Related U.S. Application Data

(60) Provisional application No. 62/871,306, filed on Jul. 8, 2019.

(51) Int. Cl.
*F02F 1/42* (2006.01)

(52) U.S. Cl.
CPC ..... *F02F 1/4285* (2013.01)

(58) Field of Classification Search
CPC ..... F02B 25/08; F02B 25/04; F02B 75/282; F02B 25/02; F02B 75/02; F02B 2720/236; F02B 2720/231; F02B 2075/025; F02F 1/22; F02F 1/186; F02F 1/4285; F01L 5/06; F02D 9/02; F02D 9/04; F02D 9/10; F02D 9/14
USPC ..... 123/193.5
See application file for complete search history.

(56) References Cited

U.S. PATENT DOCUMENTS

| | | | | |
|---|---|---|---|---|
| 3,411,289 | A | 11/1968 | Antonsen et al. | |
| 4,000,723 | A * | 1/1977 | Boyesen | F01L 3/205 123/73 AA |
| 4,066,050 | A | 1/1978 | Ford-Dunn | |
| 4,352,343 | A * | 10/1982 | Batoni | F01B 7/14 123/51 BA |
| 4,945,869 | A * | 8/1990 | Klomp | F02B 33/04 123/73 V |
| 5,638,780 | A | 6/1997 | Duvinage et al. | |
| 7,578,268 | B2 | 8/2009 | Chrisman et al. | |
| 7,895,978 | B2 | 3/2011 | Moss | |
| 8,104,438 | B2 | 1/2012 | Chrisman et al. | |
| 8,893,683 | B2 | 11/2014 | Levy et al. | |
| 9,068,498 | B2 | 6/2015 | Callahan | |
| 2012/0125291 | A1 * | 5/2012 | Simpson | H02K 35/02 123/46 E |
| 2016/0252013 | A1 | 9/2016 | Read et al. | |
| 2018/0045136 | A1 | 2/2018 | Callahan | |

FOREIGN PATENT DOCUMENTS

WO 2017078998 A1 5/2017

* cited by examiner

*Primary Examiner* — Yi-Kai Wang
(74) *Attorney, Agent, or Firm* — Faegre, Drinker, Biddle & Reath LLP

(57) ABSTRACT

A cylinder having at least one intake port and at least one exhaust port, wherein the at least one intake port includes an upper surface and a lower surface, the upper surface of the intake port having an entrance portion and an outlet portion, the upper surface arced from the entrance portion to the outlet portion.

20 Claims, 15 Drawing Sheets

42
52
44
44
44

PORT SHAPES FOR ENHANCED ENGINE BREATHING

CROSS-REFERENCE TO RELATED APPLICATION

This application claims the benefit of and priority to U.S. Application No. 62/871,306, filed Jul. 8, 2019, the content of which is hereby incorporated by reference in its entirety.

GOVERNMENT SUPPORT CLAUSE

This Project Agreement Holder (PAH) invention was made with U.S. Government support under Agreement No. W15QKN-14-9-1002 awarded by the U.S. Army Contracting Command—New Jersey (ACC-NJ) Contracting Activity to the National Advanced Mobility Consortium. The Government has certain rights in the invention.

TECHNICAL FIELD OF THE DISCLOSURE

The present disclosure relates to an engine including at least one cylinder having at least one intake port and at least one exhaust port, and more particularly, to an engine including at least one cylinder having at least one intake port and at least one exhaust port where the intake port and exhaust port shapes allow for improved performance.

BACKGROUND OF THE DISCLOSURE

There is a consistent desire to improve the performance of engines. Traditional 2-stroke intake and exhaust port designs result in substantial residual combustion material (e.g., fuel, exhaust gas, etc.) remaining in the cylinder after scavenging as well as flow separation induced by the ports. The more residual material remaining in the cylinder and the more flow separation induced by the ports, the worse the engine performs. Thus, it would be beneficial to have a 2-stroke engine with improved intake and exhaust port shapes that improve the performance of the engine and reduce the residual material remaining in the cylinder and the flow separation in or near the ports.

SUMMARY OF THE DISCLOSURE

In one embodiment of the present disclosure, a cylinder block comprises at least one cylinder having at least one intake port and at least one exhaust port, wherein the at least one intake port includes an upper surface and a lower surface, the upper surface of the at least one intake port having an entrance portion and an outlet portion, the upper surface being arced from the entrance portion to the outlet portion.

In another embodiment of the present disclosure, an engine comprises at least one cylinder having at least one intake port and at least one exhaust port, the at least one exhaust port having an upper surface and a lower surface; and at least one piston movable within the cylinder, wherein an upper surface of the at least one exhaust port is generally U-shaped.

In a further embodiment of the present disclosure, an engine comprises at least one cylinder having at least one intake port and at least one exhaust port; and at least one piston movable within the cylinder, wherein the at least one intake port includes an upper surface and a lower surface, the lower surface of the intake port including an entrance portion having a first surface, a transition portion having a second surface, and an exit portion having a third surface, the first surface extending at least one of horizontal and at an angle upward, and the third surface extending at an angle downward, the second surface being positioned between the first surface and the third surface.

BRIEF DESCRIPTION OF THE DRAWINGS

Advantages and features of the embodiments of this disclosure will become more apparent from the following detailed description of exemplary embodiments when viewed in conjunction with the accompanying drawings, wherein.

Figure 1:
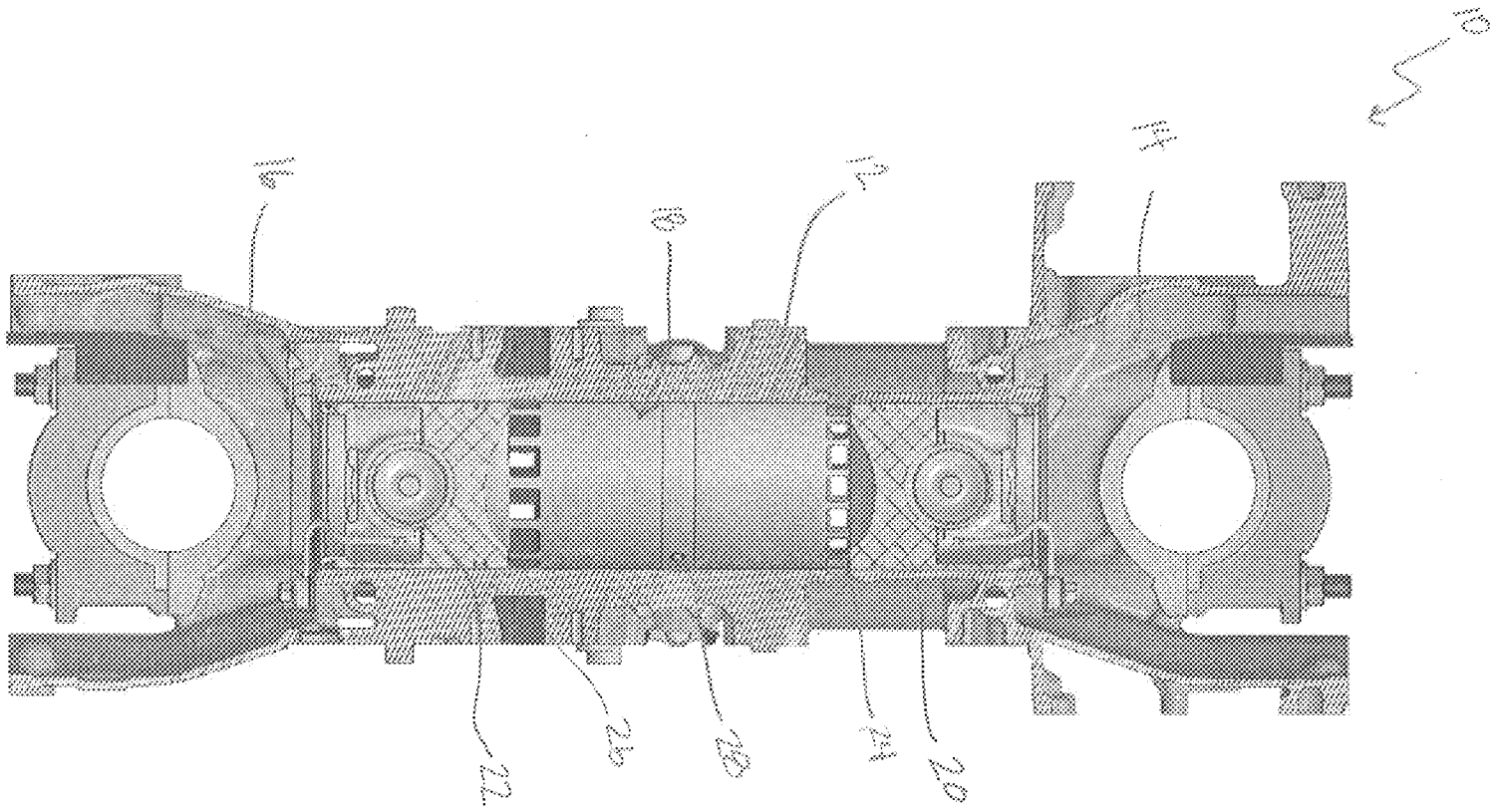
FIG. 1 is a cross-sectional view of a cylinder and opposed-pistons of an embodiment of an engine of a vehicle of the present disclosure in a scavenging state.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate embodiments of the disclosure, in one form, and such exemplifications are not to be construed as limiting the scope of the disclosure in any manner.

DETAILED DESCRIPTION OF THE DRAWINGS

Figure 2:
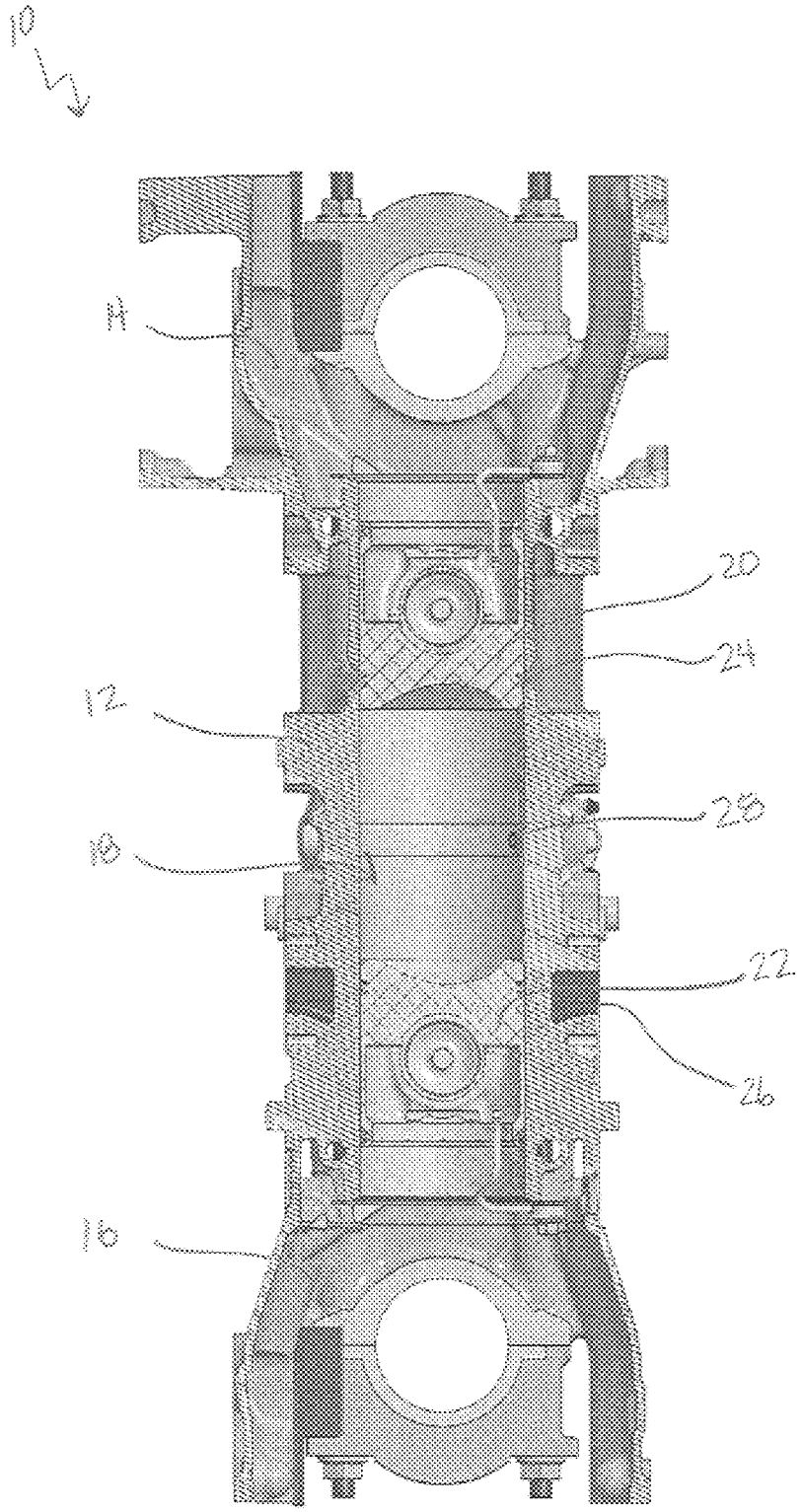
FIG. 2 is a cross-sectional view of the cylinder and opposed-pistons of the engine of FIG. 1 in an expansion or compression state.
Figure 3:
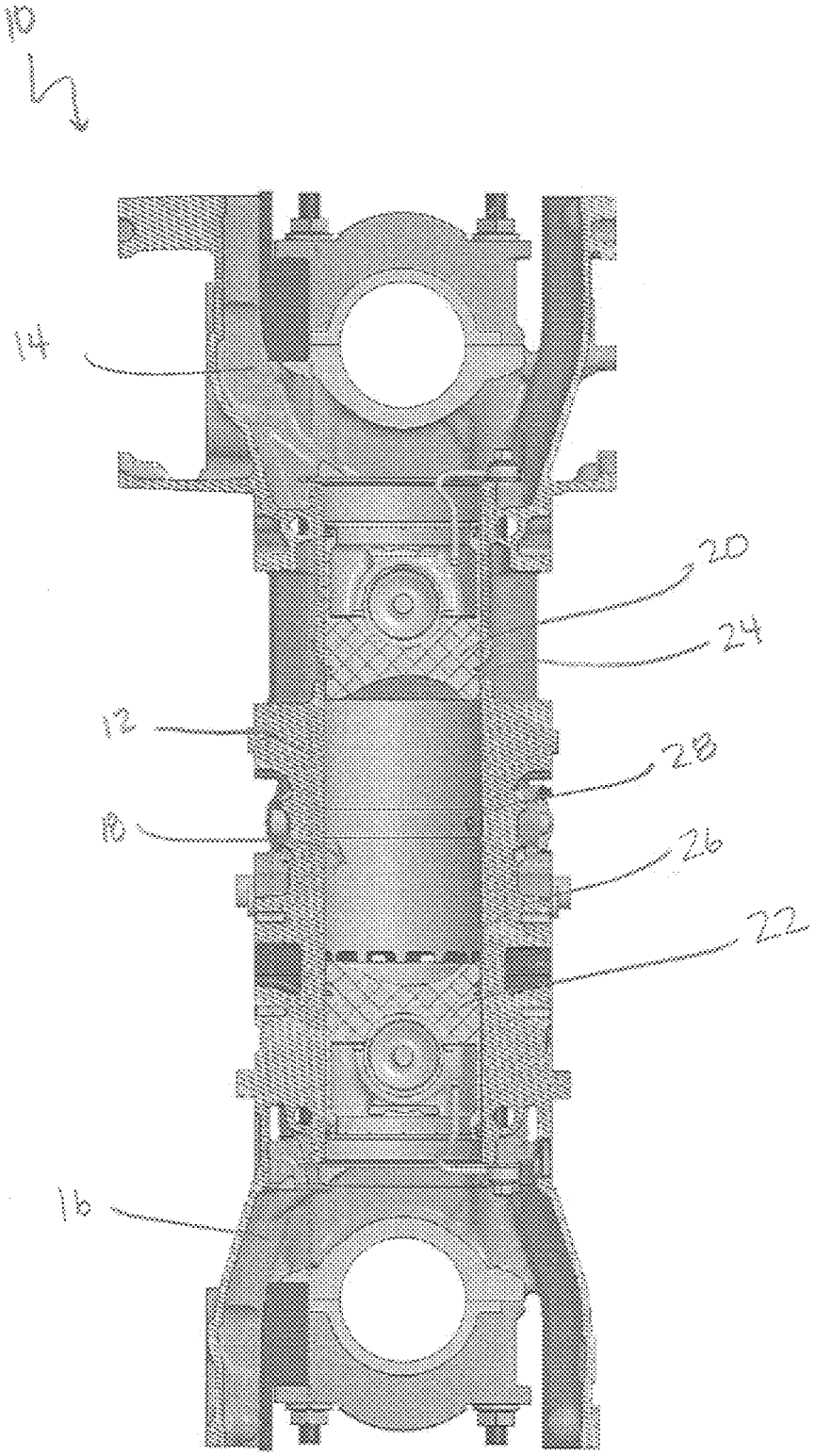
FIG. 3 is a cross-sectional view of the cylinder and opposed-pistons of the engine of FIG. 1 in an exhaust/blowdown state.

Referring to FIGS. 1-3, an engine 10 generally includes a cylinder block 12, and at least one crank case 14. In the illustrative embodiments, engine 10 is an opposed-piston engine, and includes cylinder block 12, a first crank case 14 positioned adjacent a first end of cylinder block 12, and a second crank case 16 positioned adjacent a second end of cylinder block 12.

Cylinder block 12 includes at least one cylinder 18 that houses at least one piston 20 being movable within cylinder 18. In the illustrative embodiments, cylinder 18 includes two pistons, an intake piston 20 and an exhaust piston 22. Cylinder 18 further includes at least one intake port 24, at least one exhaust port 26, and at least one fuel injector and/or at least one spark plug 28.

During an engine cycle of engine 10, engine 10 goes through a scavenging state (FIG. 1) where fresh air is pushed into cylinder 18 through intake port(s) 24 from an intake assembly 29 (FIG. 4) and exhaust is pushed out of cylinder 18 through exhaust port(s) 26, a compression state (FIG. 2) where a mixture of fuel and fresh air is compressed, ignited, and combusted, and a blowdown or exhaust state (FIG. 3) where exhaust within cylinder 18 exits cylinder 18 through exhaust port 26 and into an exhaust assembly 30 (see FIGS. 9 and 11) prior to entering the scavenging state again.

With reference to FIGS. 4, 5, 7-9, 11, 13, and 14, intake port(s) 24 and exhaust port(s) 26 are shaped to reduce in-cylinder residual remaining after the blowdown/exhaust and scavenging states of the cycle, increase fresh mass flow, reduce in-cylinder heat transfer, reduce the pressure drop within the engine during the engine cycle, reduce flow separation of the air flow in and the exhaust flow out of cylinder 18, and slow down the charge transitioning through cylinder 18.

Figure 4:
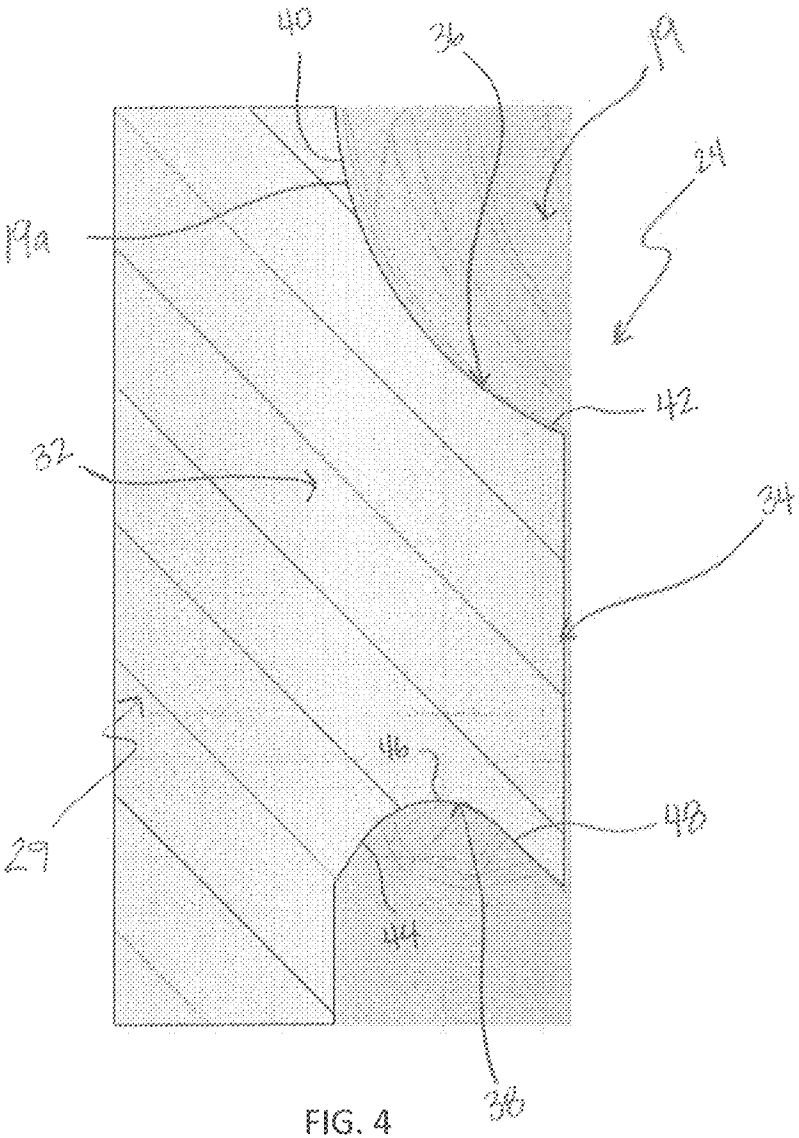
FIG. 4 is a cross-sectional view of an intake port of the cylinder of FIG. 1.
Figure 5:
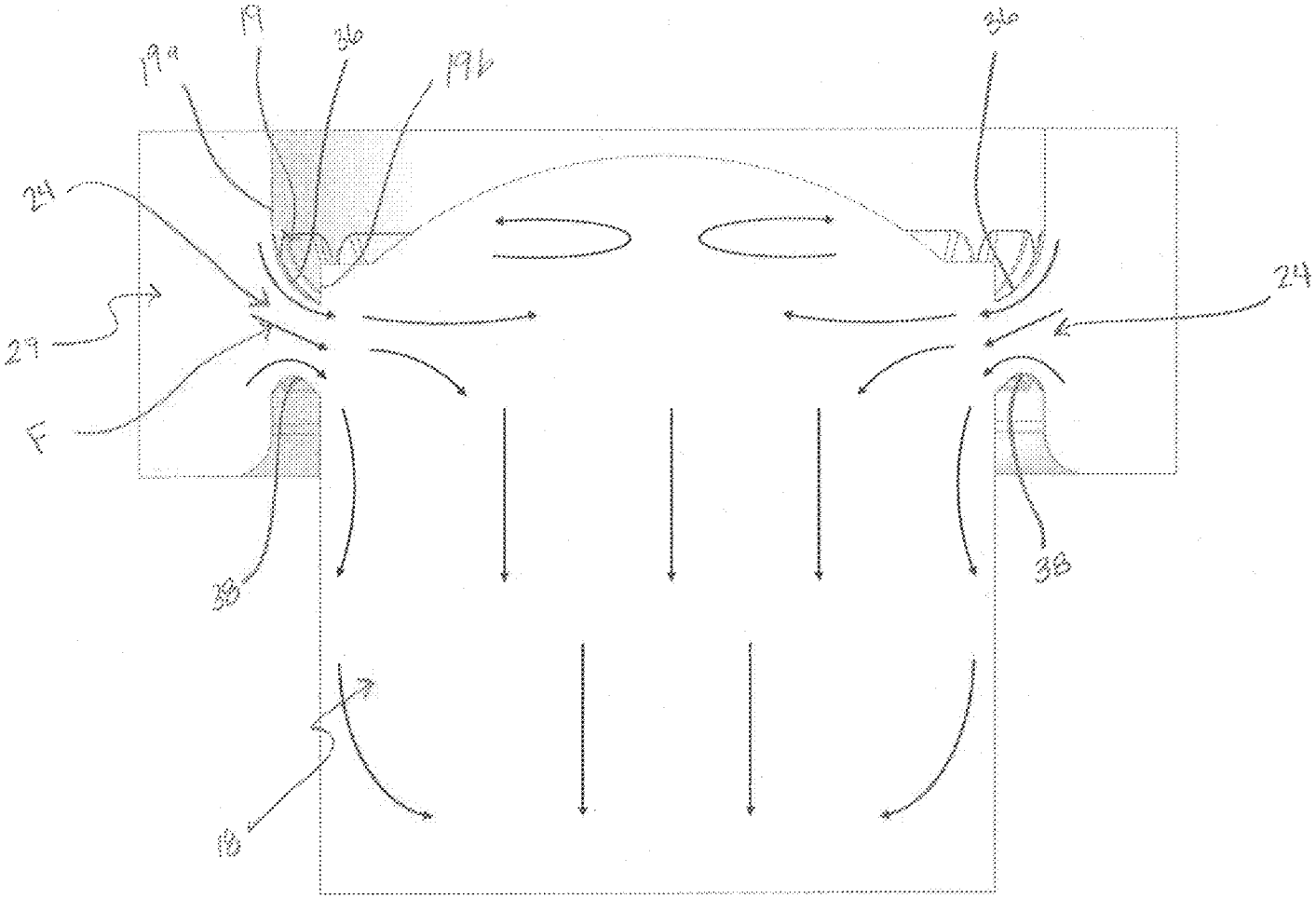
FIG. 5 is a diagram of a first portion of the cylinder of FIG. 1 showing flow patterns of exhaust gas and fresh air within the cylinder during the scavenging state.
Figure 6:
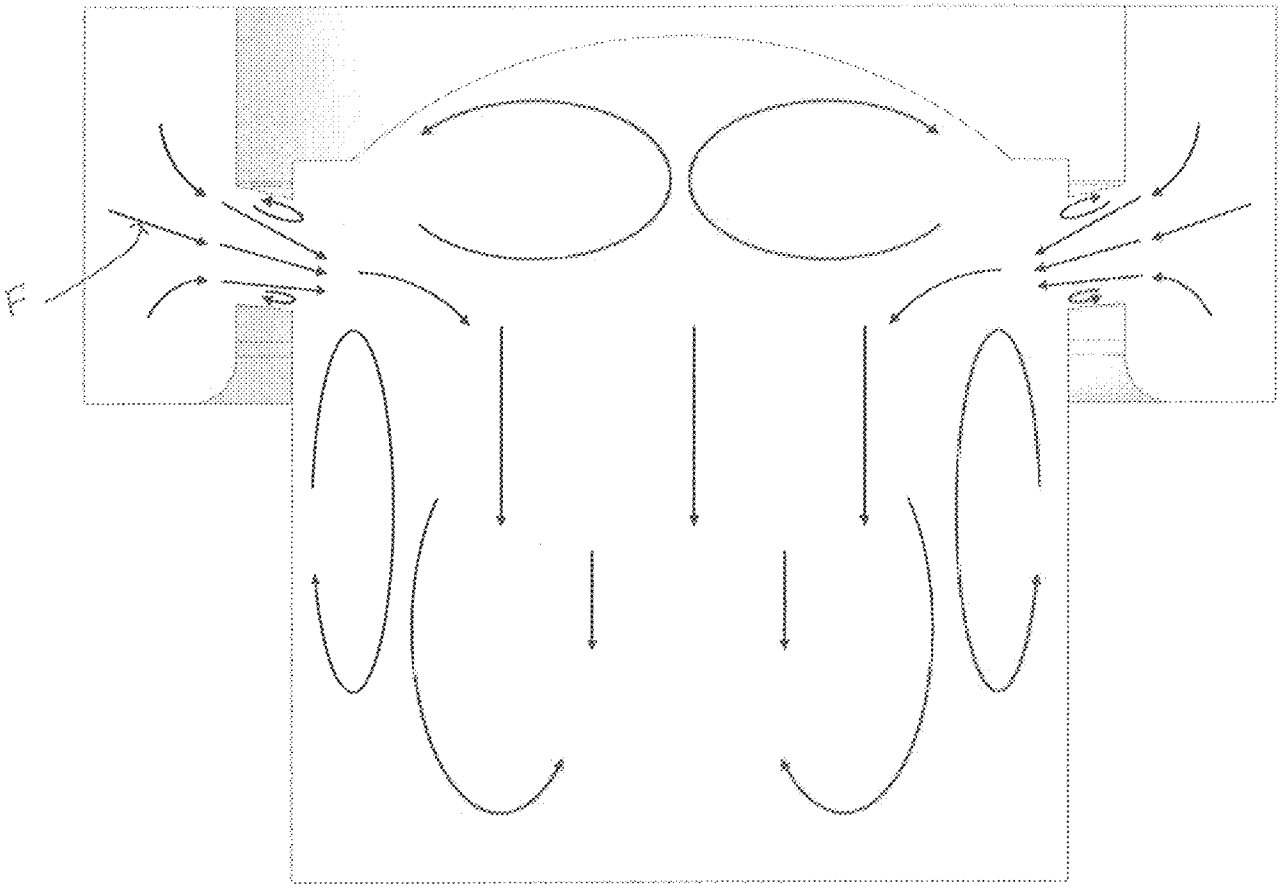
FIG. 6 (PRIOR ART)
FIG. 6 is a diagram of a prior art cylinder during a scavenging state.

Referring to FIGS. 4 and 5, intake port(s) 24 extends through a wall 19 of cylinder 18 and includes an inlet 32 adjacent intake assembly 29 on a first side 19*a* of wall 19, an outlet 34 adjacent cylinder 18 on a second side 19*b* of wall 19, an upper surface 36 and a lower surface 38, both extending between inlet 32 and outlet 34. Upper surface 36 includes an arced surface from an entrance portion 40 adjacent intake assembly 29 to an outlet portion 42 of upper surface 36 adjacent cylinder 18, which may include a gradual and continuously curved surface, a plurality of angled straight surfaces, a combination of curved and angled straight surfaces, or any other similar surface(s) capable of creating the arced surface. Lower surface 38 includes an entrance section 44 adjacent intake assembly 29, a transition section 46, and an exit section 48 adjacent cylinder 18. In various embodiments, entrance section 44 is upwardly sloped with a slope that may be as little as 1 degree. In other various embodiments, entrance section 44 may be horizontal. Exit section 48 is downwardly sloped. Transition section 46 connects entrance section 44 and exit section 48 and can either be a flat surface, a curved surface, or a combination thereof, depending on the shapes of entrance section 44 and exit section 48 and their proximities to one another. Due to the shapes of upper surface 36 and lower surface 38 at inlet 32, an entrance transition of inlet 32 is more favorable than traditional intake ports (see FIG. 6).

With reference to FIG. 5, the shape of intake port(s) 24 allows fresh air F to flow along surfaces 36 and 38 of intake port(s) 24 without separation thus reducing pressure drops within the engine and allowing for a larger effective flow area thus providing more flow to enter cylinder 18 during the same scavenging cycle as a traditionally shaped intake port. Additional air flow into cylinder 18 also allows for better performance and better heat transfers in the engine. Furthermore, additional air flow, and the fact that the shape of lower surface 38 allows for residual material to be removed from along the walls of cylinder 18, allows more residual or exhaust to be blown out of cylinder 18 leaving more fresh air F, whether fresh air F alone or mixtures of fresh air and exhaust, available for the next combustion state. With less residual remaining in cylinder 18, the charge temperature is reduced, and the cooler temperature allows for more fresh air mass to be captured in cylinder 18 for a better overall combustion event.

Figure 7:
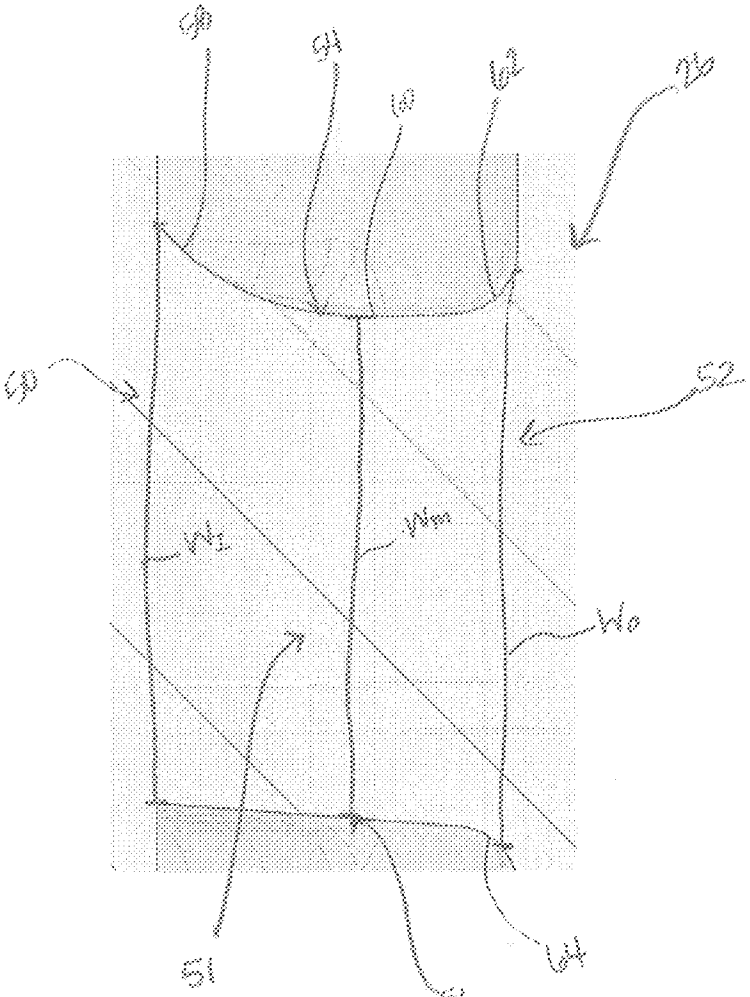
FIG. 7 is a cross-sectional view of an exhaust port of the cylinder of FIG. 1.
Figure 8:
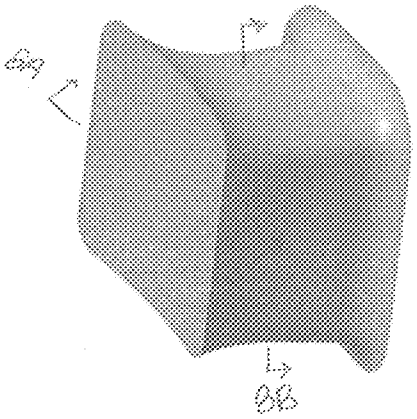
FIG. 8 is a perspective view of a geometry of the exhaust port of FIG. 7.
Figure 8B:
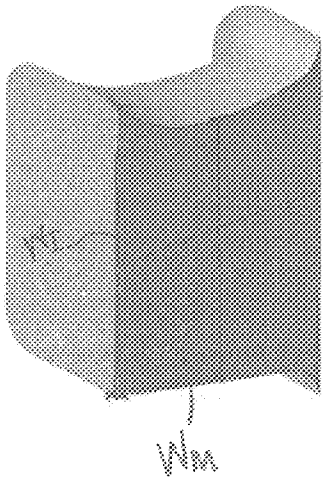
FIG. 8B is a cross-sectional view of the geometry of the exhaust port of FIG. 8 taken along the line 8B in FIG. 8.

With reference now to FIGS. 7-8B, exhaust port(s) 26 extends through wall 19 of cylinder 18 and includes an inlet 50 adjacent cylinder 18 on a first side 19*c* of wall 19, an outlet 52 adjacent exhaust assembly 30 on a second side 19*d* of wall 19, an upper surface 54, and a lower surface 56, both extending between inlet 50 and outlet 52. A width $W_M$ of exhaust port 26 near a middle section 51 of exhaust port 26 is less than both width $W_I$ of inlet 50 and $W_O$ of outlet 52.

Figure 8A:
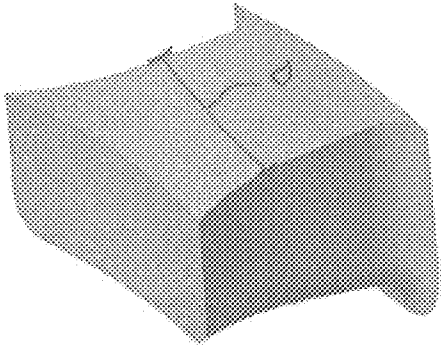
FIG. 8A is a cross-sectional view of the geometry of the exhaust port of FIG. 8 taken along the line 8A in FIG. 8.

Upper surface 54 of exhaust port 26 includes an inlet portion 58 adjacent cylinder 18 that slopes downward to a middle portion 60. Upper surface 54 further includes an outlet portion 62 adjacent exhaust assembly 30 downstream of both inlet portion 58 and middle portion 60 that slopes upward such that upper surface 54 has a generally U-shape. Lower surface 56 includes an outlet portion 64 opposite outlet portion 62 that slopes downward such that outlet 52 of exhaust port 26 is flared. Lower surface 56 also includes a downward slope from inlet 50 to outlet 52. However, the slope of lower surface 56 is not so great as to direct the exhaust flow towards a wall of exhaust assembly 30 resulting in the wall of exhaust assembly 30 being overheated. Exhaust port 26 also has a depth D (FIG. 8A) that is such to maintain the expansion ratio between approximately 0.8 and 1.5.

Figure 9:
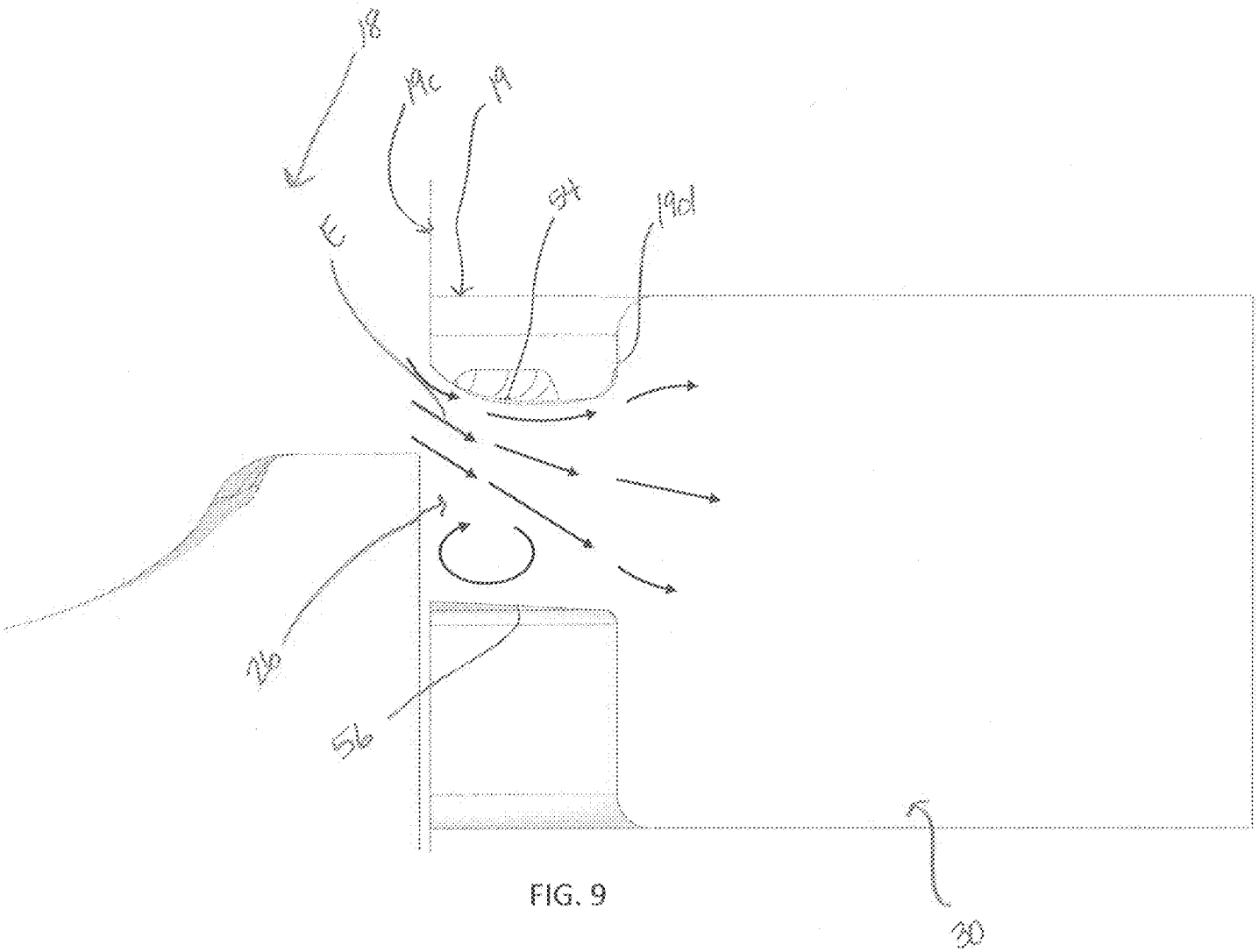
FIG. 9 is a diagram of a second portion of the cylinder of FIG. 1 including the exhaust port of FIG. 7 and a portion of an exhaust manifold of the vehicle during an exhaust or blowdown state.
Figure 10:
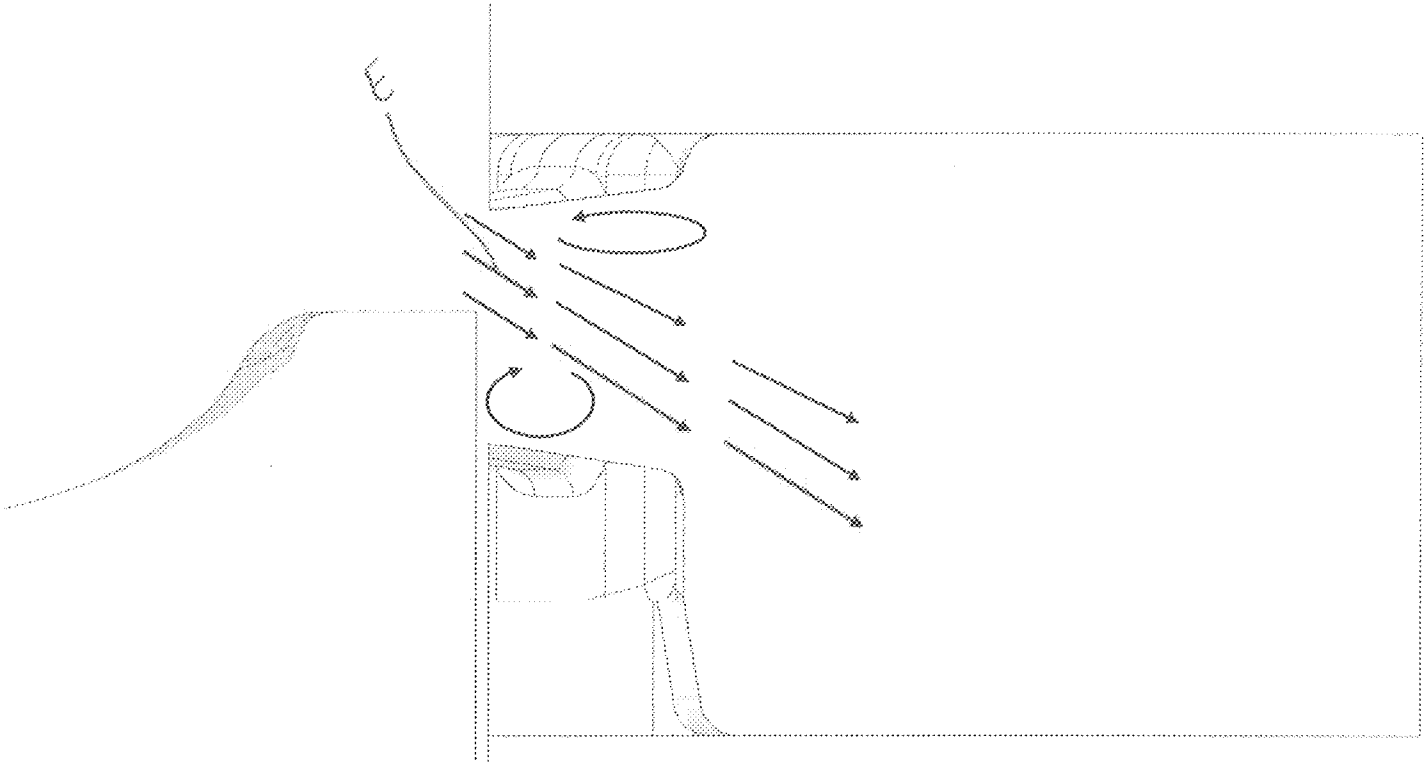
FIG. 10 (PRIOR ART)
FIG. 10 is a diagram of a prior art cylinder during an exhaust or blowdown state.
Figure 11:
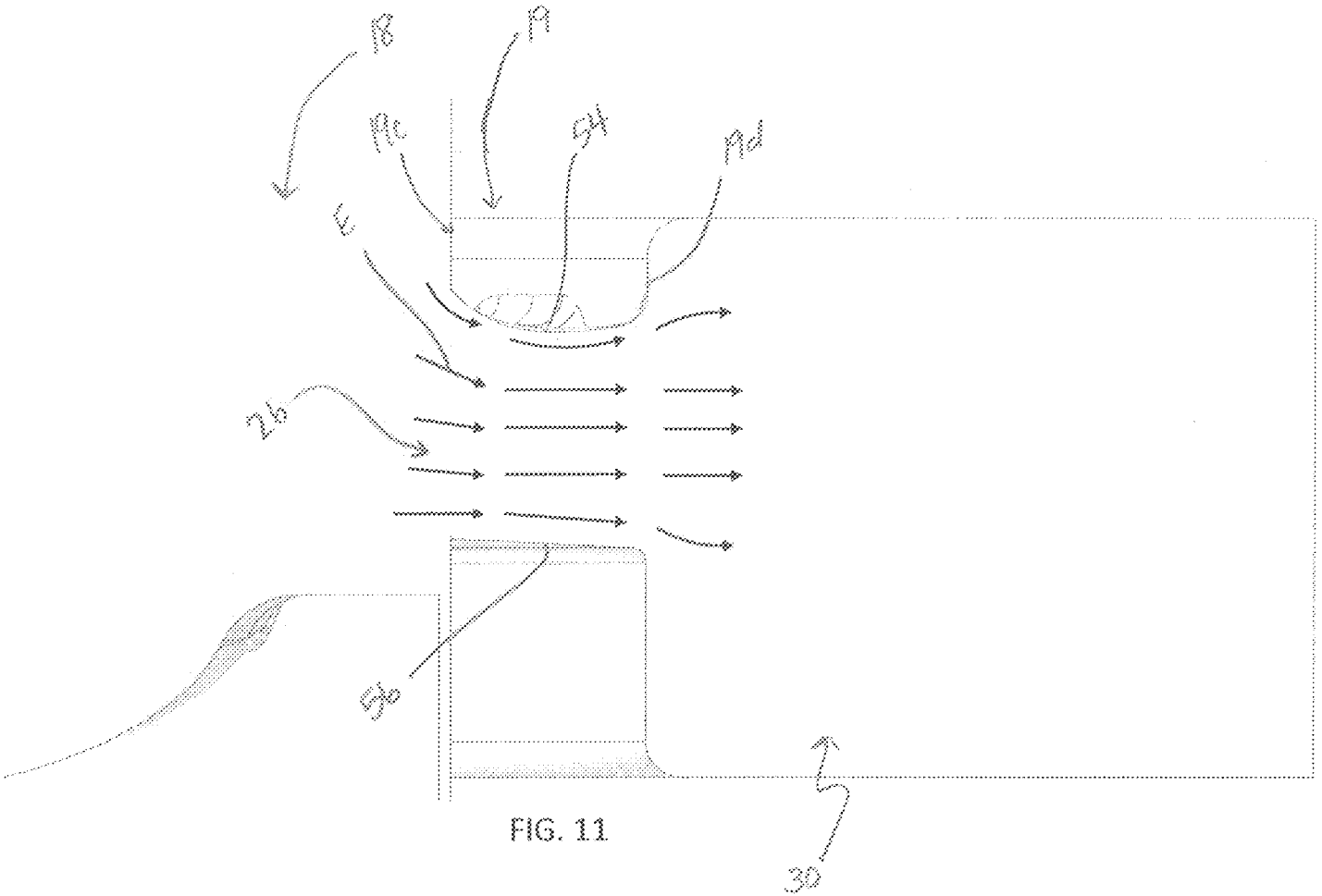
FIG. 11 is a diagram of the second portion of the cylinder, the exhaust port, and the exhaust manifold of FIG. 9 during the scavenging state.
Figure 12:
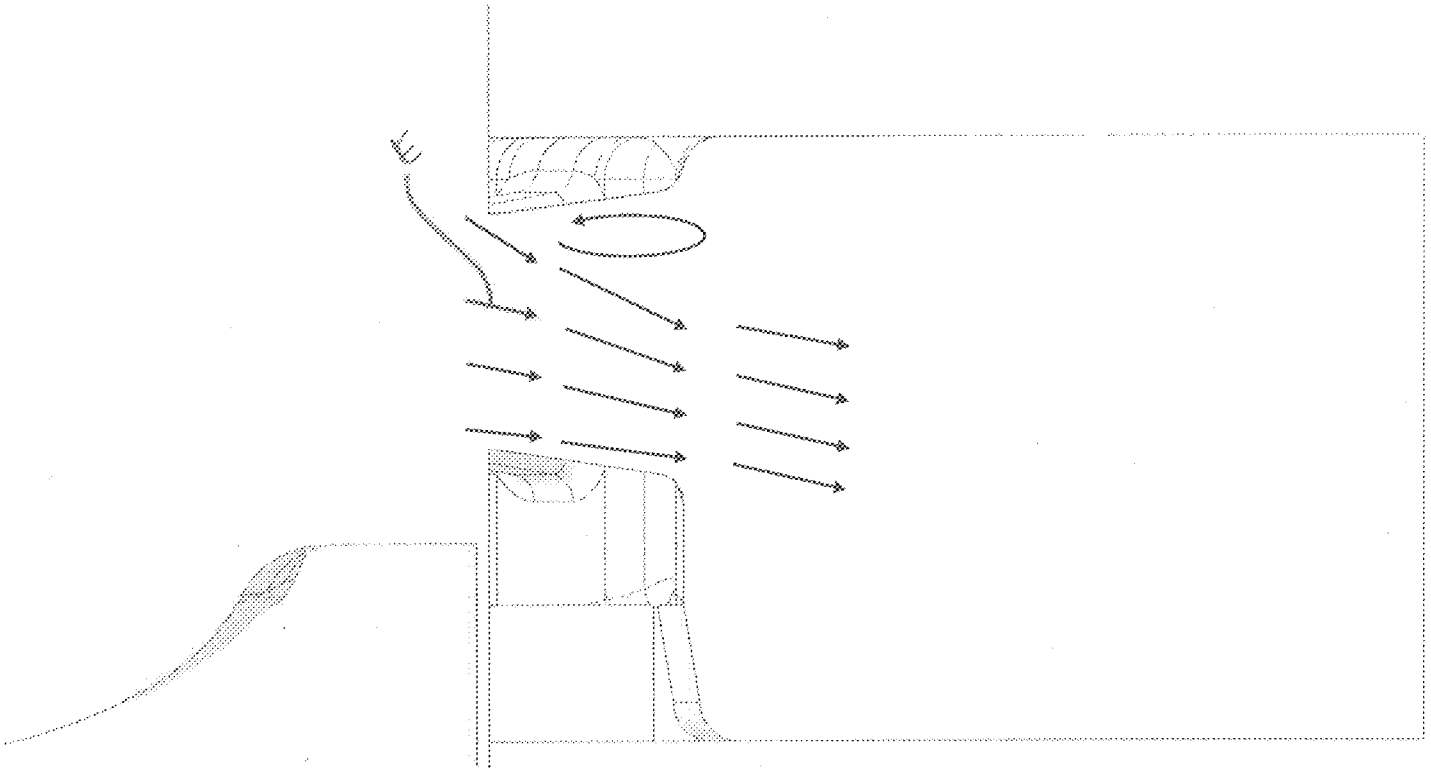
FIG. 12 (PRIOR ART)
FIG. 12 is a diagram of a prior art cylinder during a scavenging state.

With reference to FIGS. 9 and 11, the shape of exhaust port(s) 26 also allows the engine pressure drop to be reduced by keeping the exhaust flow E attached or connected to the upper port surface 54, thus reducing pressure drop and increasing effective flow area as compared to traditional exhaust ports (see FIGS. 10 and 12).

Figure 13:
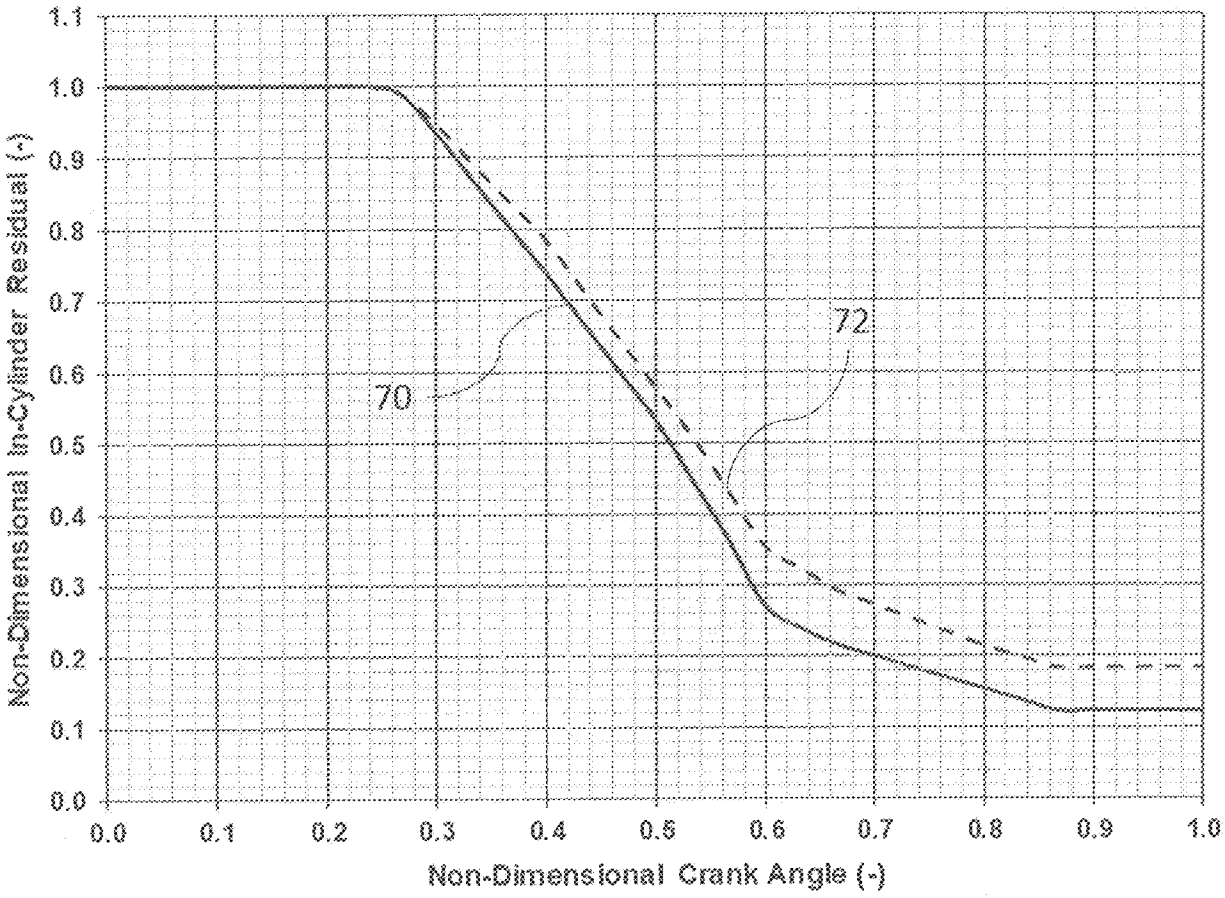
FIG. 13 is a diagram comparing normalized in-cylinder residual versus normalized crank angles of the engine of FIG. 1 to similar measurements of traditional 2-stroke engine configurations during the same normalized crank angles of the engine.

Referring to FIG. 13, the shapes of intake(s) port 24 and exhaust(s) port 26 allow the normalized in-cylinder residual 70 to be lower than normalized in-cylinder residual of traditionally shaped ports 72 after the engine cycle is complete.

Figure 14:
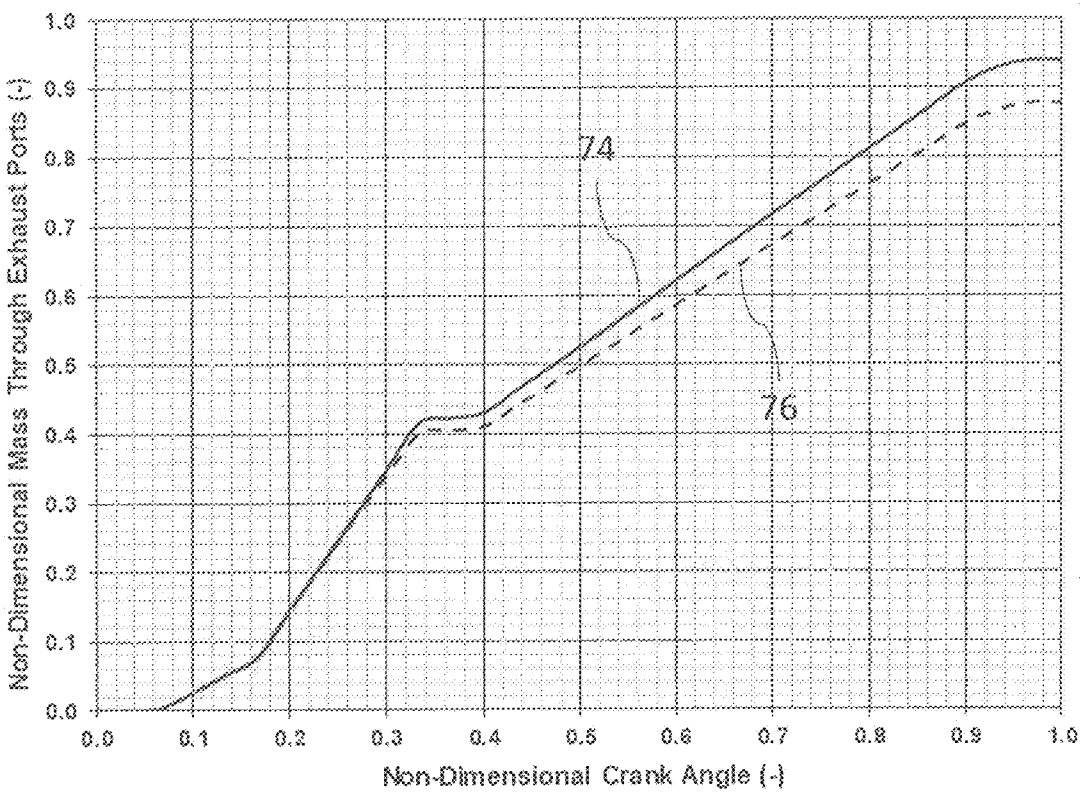
FIG. 14 is a diagram comparing normalized exhaust port mass versus normalized crank angles of the engine of FIG. 1 to similar measurements of traditional 2-stroke engine configurations during the same normalized crank angles of the engine.

With reference to FIG. 14, the shapes of intake port(s) 24 and exhaust port(s) 26 also allow normalized mass through the exhaust ports 74 to generally be greater than the normalized mass through the exhaust ports caused by traditionally shaped ports 76. More exhaust port mass means better scavenging, lower pressure loss and better engine performance due to improved combustion conditions.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A cylinder block, comprising:

at least one cylinder that is formed in the cylinder block to thereby form a cylinder wall, the at least one cylinder configured to be in communication with each of at least one intake port, each of the at least one intake port and the at least one exhaust port being positioned at the cylinder wall, the cylinder wall includes a first cylinder side and a second cylinder side configured to receive at least one piston, the first cylinder side and the second cylinder side being opposite sides of the cylinder wall such that the first cylinder side is an outer wall side of the cylinder wall and the second cylinder side is an inner wall side of the at least one cylinder; and wherein the at least one intake port includes an upper surface and a lower surface, the upper surface of the at least one intake port extending downwardly between the first cylinder side and the second cylinder side and having an entrance portion that is adjacent the first cylinder side and an outlet portion that is adjacent the second cylinder side, the upper surface being arced from the entrance portion to the outlet portion.

2. The cylinder block of claim 1, wherein the lower surface of the at least one intake port includes an entrance portion having a first surface, a transition portion having a second surface, and an exit portion having a third surface, the first surface extending at least one of horizontal and at an angle upward, and the third surface extending at an angle downward, the second surface being positioned between the first surface and the third surface.

3. The cylinder block of claim 2, wherein the second surface includes at least one of a flat portion and a curved portion.

4. The cylinder block of claim 2, wherein the first surface extends horizontally.

5. The cylinder block of claim 2, wherein the first surface extends at an angle upward.

6. The cylinder block of claim 2, wherein the exit portion of the lower surface has a downward angle.

7. The cylinder block of claim 1 further comprising a wall, the at least one intake port being positioned within the wall and extending from a first side of the wall to a second side of the wall, an inlet portion of the at least one intake port being adjacent the first side of the wall and an outlet portion of the at least one intake port being adjacent the second side of the wall.

8. A cylinder block assembly, comprising:

a cylinder block having at least one cylinder that is formed in the cylinder block to thereby form a cylinder wall, the at least one cylinder configured to be in communication with each of at least one intake port and at least one exhaust port, each of the at least one intake port and the at least one exhaust port being positioned at the cylinder wall, the at least one exhaust port having an upper surface and a lower surface the cylinder wall includes a first cylinder side and a second cylinder side configured to movably receive at least one piston, the first cylinder side and the second cylinder side being opposite sides of the cylinder wall such that the first cylinder side is an outer wall side of the cylinder wall and the second cylinder side is an inner wall side of the at least one cylinder; and at least one piston that is movable within the at least one cylinder, wherein the upper surface of the at least one exhaust port extends downwardly between the first cylinder side and the second cylinder side and is generally U-shaped.

9. The cylinder block assembly of claim 8, wherein the upper surface has an entrance portion with a downward angle.

10. The cylinder block assembly of claim 8, wherein the at least one exhaust port further includes an expansion ratio between approximately 0.8 and 1.5.

11. The cylinder block assembly of claim 8, wherein the at least one cylinder is configured to operate as a part of a 2-stroke engine.

12. The cylinder block assembly of claim 8 further including an exhaust assembly, the at least one exhaust port extending from the at least one cylinder to the exhaust assembly, wherein an inlet portion of the at least one exhaust port is adjacent the at least one cylinder and an outlet portion of the at least one exhaust port is adjacent the exhaust assembly.

13. A cylinder block, comprising:

at least one cylinder that is formed in the cylinder block to thereby form a cylinder wall, the cylinder wall includes a first cylinder side and a second cylinder side configured to receive at least one piston, the first cylinder side and the second cylinder side being opposite sides of the cylinder wall such that the first cylinder side is an outer wall side of the cylinder wall and the second cylinder side is an inner wall side of the at least one cylinder; and at least one intake port and at least one exhaust port, each of the at least one intake port and the at least one exhaust port being positioned at the cylinder wall; and wherein the at least one intake port includes an upper surface and a lower surface, the upper surface of the at least one intake port extending downwardly from the first cylinder side to the second cylinder side, the lower surface including an entrance portion having a first surface, a transition portion having a second surface, and an exit portion having a third surface, the first surface extending at least one of horizontal and at an angle upward, and the third surface extending at an angle downward, the second surface being positioned between the first surface and the third surface.

14. The cylinder block of claim 13, wherein the at least one cylinder is configured for operation as part of a 2-stroke engine.

15. The cylinder block of claim 13, wherein the second surface includes at least one of a flat portion and a curved portion.

16. The cylinder block of claim 13, wherein the first surface extends horizontally.

17. The cylinder of claim 13, wherein the first surface extends at an angle upward.

18. The cylinder of claim 14 further comprising an intake assembly and an exhaust assembly, the at least one intake port being positioned within a wall of the at least one cylinder and extending from the intake assembly to the cylinder, an inlet portion of the at least one intake port being adjacent the intake assembly and an outlet portion of the at least one intake port being adjacent the at least one cylinder, and the at least one exhaust port extending from the at least one cylinder to the exhaust assembly, wherein an inlet portion of the at least one exhaust port is adjacent the at least one cylinder and an outlet portion of the at least one exhaust port is adjacent the exhaust assembly.

19. The cylinder of claim 13, wherein the exit portion of the lower surface has a downward angle.

20. The cylinder block of claim 1, wherein the cylinder block is configured for operation as part of a 2-stroke engine.

* * * * *